US007971468B2

(12) United States Patent
Coalson et al.

(10) Patent No.: US 7,971,468 B2
(45) Date of Patent: Jul. 5, 2011

(54) PART TRANSFER SYSTEM AND METHOD

(75) Inventors: Glen Coalson, Troy, MI (US); David A. Sofy, Troy, MI (US)

(73) Assignee: HMS Products Co., Troy, MI (US)

( * ) Notice: Subject to any disclaimer, the term of this patent is extended or adjusted under 35 U.S.C. 154(b) by 440 days.

(21) Appl. No.: 12/178,079

(22) Filed: Jul. 23, 2008

(65) Prior Publication Data

US 2010/0018043 A1 Jan. 28, 2010

(51) Int. Cl.
*B21D 43/05* (2006.01)

(52) U.S. Cl. .... 72/405.09; 72/405.01; 72/60; 198/621.1

(58) Field of Classification Search ..... 72/56, 60, 72/405.01, 405.09; 198/621.1
See application file for complete search history.

(56) References Cited

U.S. PATENT DOCUMENTS 3,630,391 A 12/1971 Wilson
4,359,153 A 11/1982 Gerben et al.
5,423,202 A 6/1995 Komatsu et al.
5,572,898 A * 11/1996 Horde et al. ..... 72/405.16
5,690,026 A * 11/1997 Thudium et al. ..... 100/207
5,842,370 A 12/1998 Hofele et al.
6,223,582 B1 5/2001 Hofele et al.
6,314,786 B1 * 11/2001 Hofele et al. ..... 72/405.11
6,742,457 B2 6/2004 Shiroza
6,792,787 B1 * 9/2004 Coalson ..... 72/405.16
7,017,383 B2 3/2006 de Sousa Monteiro
7,210,326 B2 * 5/2007 Kawamoto ..... 72/405.11
7,624,614 B2 * 12/2009 Heid et al. ..... 72/405.16
7,748,249 B2 * 7/2010 Shiroza ..... 72/422

* cited by examiner

*Primary Examiner* — David B Jones
(74) *Attorney, Agent, or Firm* — Harold W. Milton, Jr.; Dickinson Wright, PLLC

(57) ABSTRACT

A transfer assembly (22) for moving a work-piece (26) between stations of a hydroforming and/or hydrotrimming assembly. The transfer assembly (22) includes left and right posts (40, 42) spaced from and parallel to each other and extending vertically. A left top arm (56) and a left bottom arm (58) and a right top arm (62) and a right bottom arm (64) extend in spaced and parallel relationship with each other transversely to the posts (40, 42) to distal ends (60, 84). An upper rail (80) extends between the distal ends (60) of the top arms (56, 62) and a lower rail (82) extends between the distal ends (60) of the bottom arms (58, 64). The rails (80, 82) each include a plurality of part grabbers (86, 88) for engaging the work-piece (26). A transfer module interconnects each arm with the associated post for moving the arms (56, 58, 62, 64) vertically up and down and for moving the arms (56, 58, 62, 64) in and out. A rail transfer module (74) interconnects each arm with the associated rail for moving the rails (80, 82) side-to-side.

24 Claims, 4 Drawing Sheets

PART TRANSFER SYSTEM AND METHOD

BACKGROUND OF THE INVENTION

1. Field of the Invention

The subject invention relates to a high speed vertical part transfer assembly for moving parts in a hydroforming assembly or a part trimming assembly.

2. Description of the Prior Art

Hydroforming generally is the use of fluid pressure to expand a blank, or a work-piece, to comply with the shape of the cavity of a die. Hydrotrimming is the process of cutting and trimming parts through the use of a hydraulic fluid. Hydroforming or hydrotrimming machines generally include a die having a cavity defining a negative mold of a final part. A work-piece is placed in the cavity of the die, and a high pressure hydraulic fluid is injected into the work-piece to cause the work-piece to conform to the shape of the negative mold.

The dies of the hydroforming and hydrotrimming assemblies of the prior art are laid horizontally with two halves moveable relative to each other parallel to a vertical-axis. A common problem with such hydroforming assemblies is that fluid and other residue is left in the final part following the hydroforming process. Similarly, the scrap material cut away from the work-piece during a hydrotrimming process must manually be removed from the die and away from the work-piece.

Other manufacturing processes, e.g. stamping, often sequentially shape a work-piece through a series of stations to form a part having a complex shape. A part transfer assembly is then required to bring the work-piece to the first station, transfer the work-piece between the stations, and remove the work-piece from the final station. An example of such a transfer assembly is disclosed in U.S. Pat. No. 7,017,383, issued on Mar. 28, 2006 to Luciano Trindade de Sousa Monteiro (hereinafter referred to as "Trindade '383"). The Trindade '383 patent discloses a transfer system including a pair of rails extending in spaced and parallel relationship with each other and parallel to a horizontal-axis. A plurality of horizontally spaced part grabbers is disposed on each of the rails for engaging a work-piece. A plurality of transfer modules engages each of the rails for moving the rails side-to-side parallel to the horizontal-axis for moving the rails vertically up and down parallel to a vertical-axis.

SUMMARY OF THE INVENTION AND ADVANTAGES

The invention relates to such a forming assembly for hydroforming or hydrotrimming a work-piece and including a left post and a right post spaced from and extending parallel to each other and parallel to a vertical-axis. A left top arm extends transversely from the left post and parallel to a horizontal in/out-axis to an outer distal end. A right top arm extends transversely from the right post and parallel to the in/out-axis to the outer distal end. A left top transfer module interconnects the left post and the left top arm for moving the left top arm in and out parallel to the in/out-axis and vertically up and down relative to the left post parallel to the vertical-axis. A right top transfer module interconnects the right post and the right top arm for moving the right top arm in and out parallel to the in/out-axis and vertically up and down relative to the right post parallel to the vertical-axis. An upper rail extends across the distal ends of the left top arm and the right top arm and parallel to a horizontal station-axis. A rail transfer module is disposed on each of the top arms and operatively connects the upper rail to the distal ends of the arms for moving the upper rail side-to-side parallel to the station-axis. At least one upper part grabber is disposed on the upper rail for engaging a work-piece.

The subject invention holds the work-piece in a vertical orientation parallel to the vertical-axis. In the hydroforming process, the work-piece is pressurized in each of the cavities of the die, and when the work-piece is removed from the cavity, the fluid along with any residue is flushed out of the work-piece by gravity. Similarly, in the hydrotrimming process, the work-piece can be trimmed in the die cavity and secondary trimming operations can be reduced or eliminated.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, the invention is a forming machine 20 including a transfer assembly 22 having a horizontal in/out-axis X and a horizontal station-axis Y perpendicular to the in/out-axis X and a vertical-axis Z. In the exemplary embodiment, the forming machine 20 is a hydroforming machine, but it is to be appreciated that it may also be a hydrotrimming machine.

Figure 1:
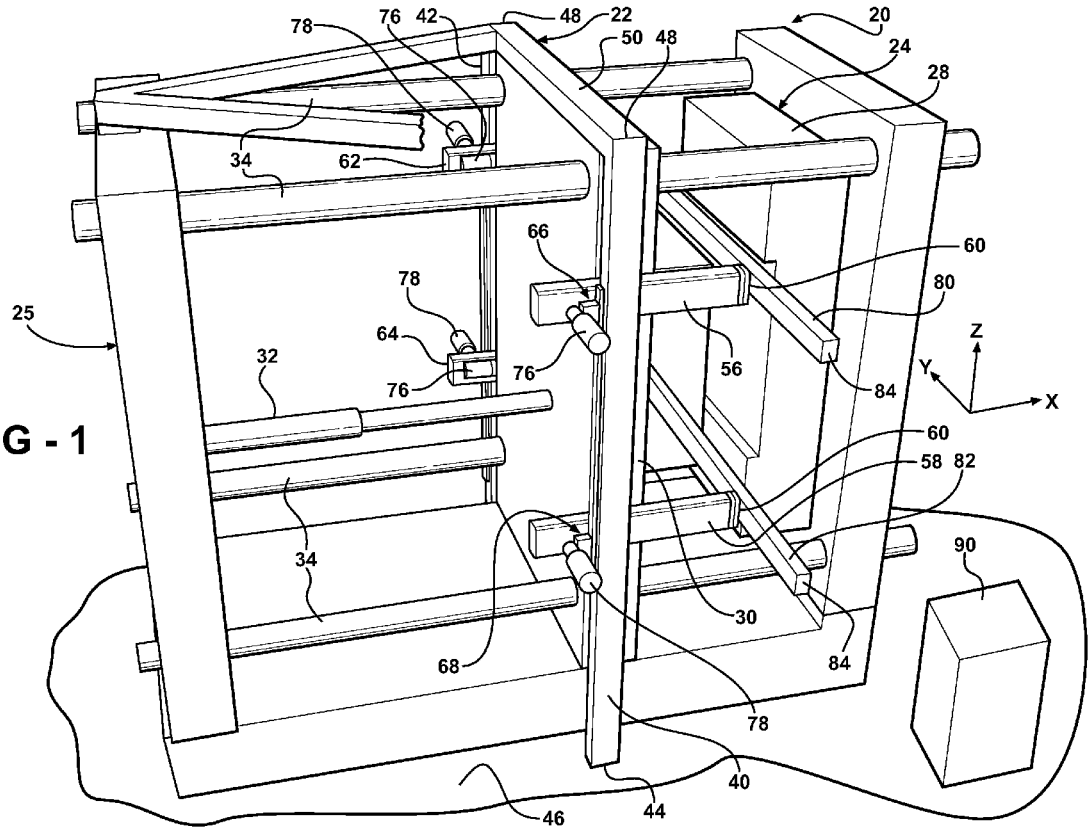
FIG. 1 is a perspective view of the subject invention.
Figure 2:
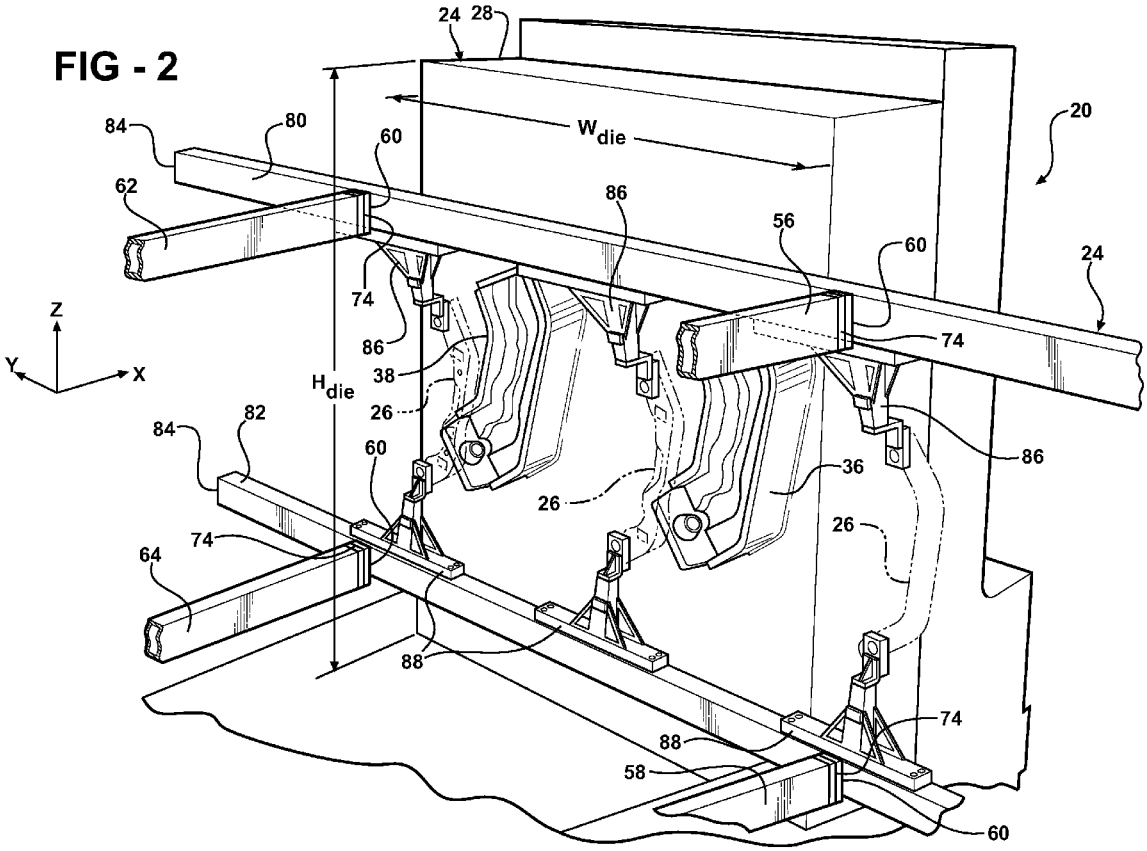
FIG. 2 is a perspective and fragmentary view of the subject invention with each of the part grabbers engaging a work-piece.

The forming machine 20, which is generally shown in FIGS. 1 and 2, includes a die 24 disposed on a press 25. The die 24 has a die width $W_{die}$ and a die height $H_{die}$ and includes a plurality of forming stations spaced from each other for successively hydroforming or hydrotrimming a work-piece 26. The press 25 and the die 24 are generally indicated in FIGS. 1 and 2, and the die 24 includes a front half 28 and a back half 30. The press 25 includes an actuator 32 for moving the front and back halves 28, 30 of the die 24 relative to one another parallel to the in/out-axis X between open and closed positions. The press 25 includes a plurality of cylindrical guides 34 extending through the front and back halves 28, 30 of the die 24 for guiding the die 24 to the open and closed positions. In the exemplary embodiment, one of the cylindrical guides 34 is disposed at each of the four corners of the die 24, and the front half 28 and the back half 30 of the die 24 each present a plurality of cavities 36, 38 to define the stations for successively hydroforming or hydrotrimming the work-piece 26. It is to be appreciated that the die 24 could include any number of stations depending on the complexity of the final work product, and the stations do not have to be cavities 36, 38 but could be any other means of holding the work-piece 26 for the hydroforming or hydrotrimming process.

Figure 3:
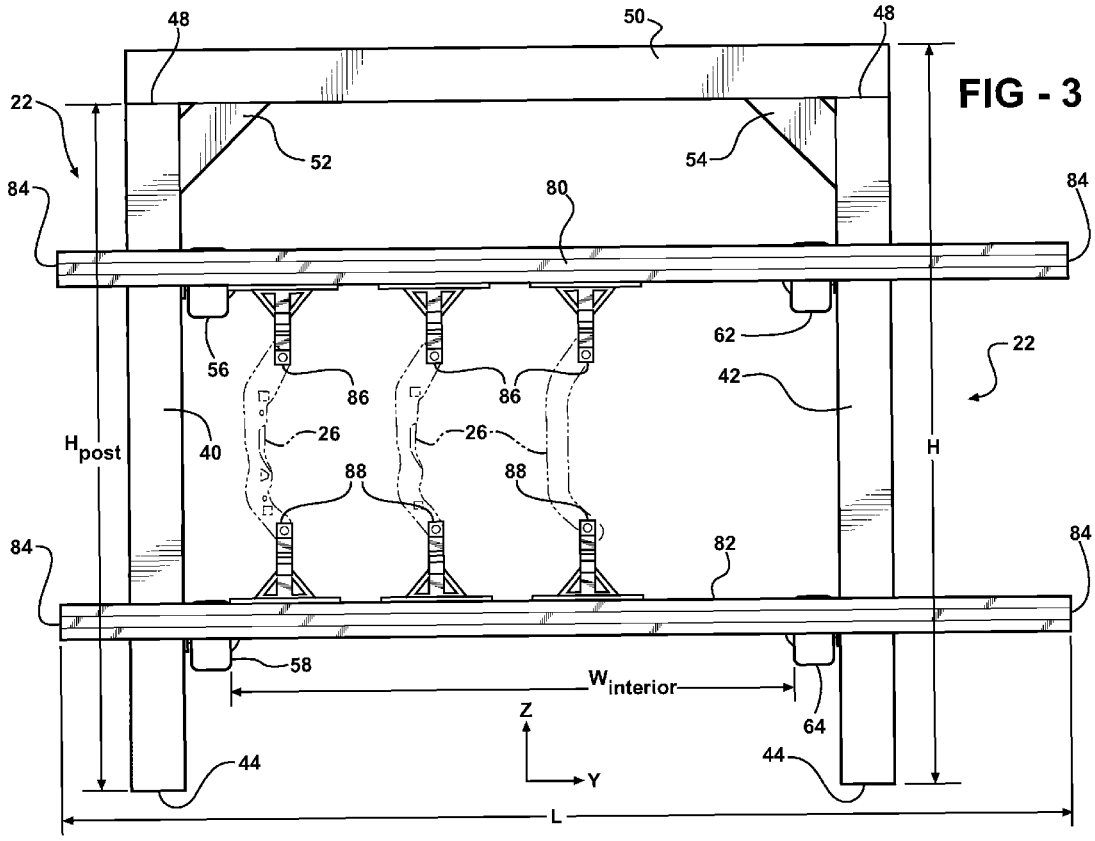
FIG. 3 is a front view of the transfer assembly with each of the part grabbers engaging a work-piece.
Figure 4:
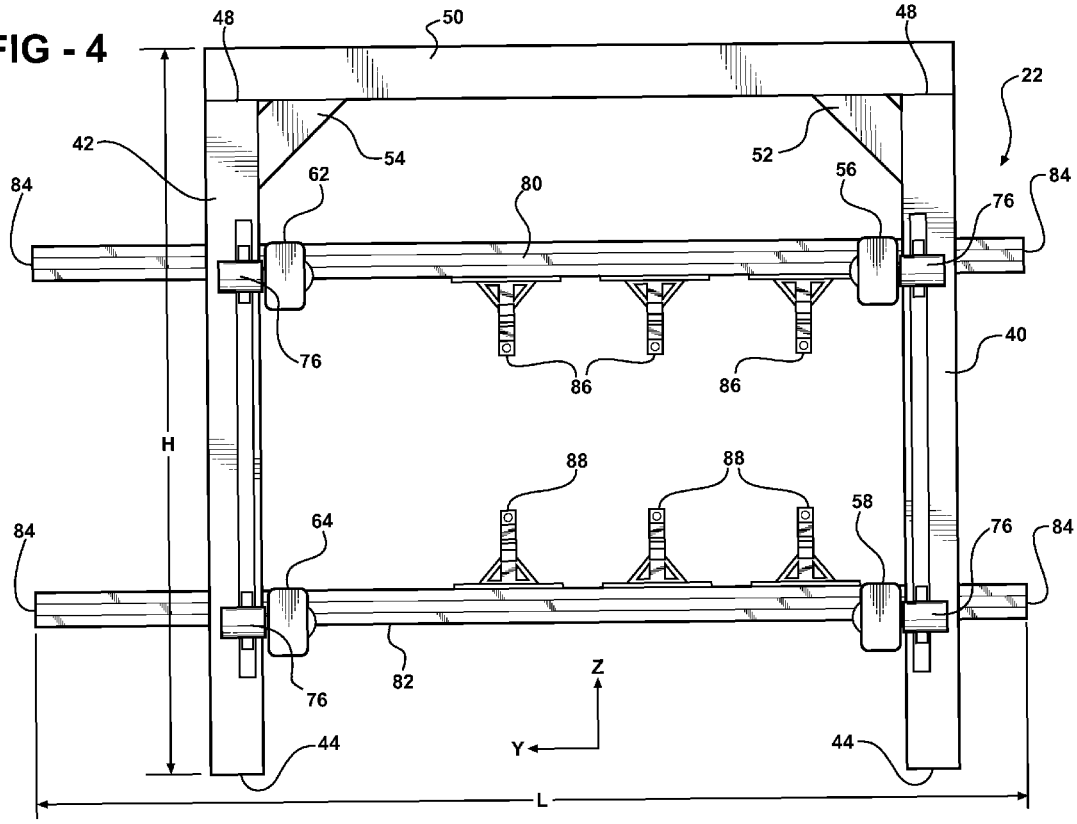
FIG. 4 is a rear view of the transfer assembly.

The transfer assembly 22 is generally indicated in FIG. 1 and generally shown in FIGS. 3 and 4 and includes a left post 40 and a right post 42 spaced from each other and extending parallel to each other and parallel to the vertical-axis Z. In the exemplary embodiment, the posts 40, 42 have bottoms 44 for engaging a support surface 46 and extend vertically upward to tops 48. However, depending on the configuration of the press 25, the posts 40, 42 may engage the press 25 rather than the support surface 46. Each of the posts 40, 42 has a post height $H_{post}$ being greater than the die height $H_{die}$. A horizontal member 50 extends parallel to the station-axis Y between and interconnects the tops 48 of the posts 40, 42. A left truss 52 is disposed under the horizontal member 50 and interconnects the left post 40 and the horizontal member 50 and a right truss 54 disposed under the horizontal member 50 and interconnects the right post 42 and the horizontal member 50.

The left and right posts 40, 42 are disposed on either side of the die 24 and the horizontal member 50 is disposed above the die 24 so that the die 24 can move between the open and closed positions without interfering with the posts 40, 42 or the horizontal member 50.

A left top arm 56 and a left bottom arm 58 extend in spaced and parallel relationship with each other transversely to the left post 40 and parallel to the in/out-axis X to outer distal ends 60, and a right top arm 62 and a right bottom arm 64 extend in spaced and parallel relationship with each other transversely to the right post 42 and parallel to the in/out-axis X to outer distal ends 60. The top arms 56, 62 are vertically spaced parallel to the vertical-axis Z from the bottom arms 58, 64, and all of the arms 56, 58, 62, 64 have the same length.

The left arms 56, 58, 62, 64 are horizontally spaced from the right arms 56, 58, 62, 64 parallel to the station-axis Y by an interior width $W_{interior}$ being greater than the die width $W_{die}$ so that the die 24 halves 28, 30 can move between the open and closed positions without interfering with the arms 56, 58, 62, 64 of the transfer assembly 22.

A left top transfer module 66 interconnects the left post 40 and the left top arm 56 for moving the left top arm 56 in and out parallel to the in/out-axis X and vertically up and down relative to the left post 40 parallel to the vertical-axis Z. A left bottom transfer module 68 interconnects the left post 40 and the left bottom arm 58 for moving the left bottom arm 58 in and out parallel to the in/out-axis X and vertically up and down relative to the left post 40 parallel to the vertical-axis Z. A right top transfer module 70 interconnects the right post 42 and the right top arm 62 for moving the right top arm 62 in and out parallel to the in/out-axis X and vertically up and down relative to the right post 42 parallel to the vertical-axis Z. A right bottom transfer module 72 interconnects the right post 42 and the right bottom arm 64 for moving the right bottom arm 64 in and out parallel to the in/out-axis X and vertically up and down relative to the right post 42 parallel to the vertical-axis Z.

Each of the transfer modules 66, 68, 70, 72 includes a vertical servo motor 76 for moving the associated arm vertically up and down parallel to the vertical-axis Z, and each of the transfer modules 66, 68, 70, 72 includes a longitudinal servo motor 78 for moving the associated arm in and out parallel to the in/out-axis X.

An upper rail 80 extends across the outer distal ends 60 of the left top arm 56 and the right top arm 62 and parallel to the station-axis Y, and a lower rail 82 extends across the distal ends 60 of the left bottom arm 58 and the right bottom arm 64 and parallel to the station-axis Y. Each of the rails 80, 82 has a rail length L between rail ends 84 greater than the distance between the arms 56, 58, 62, 64 parallel to the station-axis Y. A rail transfer module 74 is disposed on each of the arms 56, 58, 62, 64 and operatively connects the rails 80, 82 to the distal ends 60 of the arms 56, 58, 62, 64 for moving the upper and lower rails 80, 82 side-to-side parallel to the station-axis Y between stop positions with one of the rail ends 84 adjacent one of the arms 56, 58, 62, 64. The upper rail 80 may be controlled independently of the movement and the position of the lower rail 82 depending on the orientation or the shape of the die 24.

A plurality of upper part grabbers 86 is disposed on the upper rail 80 for engaging the work-piece 26. The upper part grabbers 86 extend downwardly from the upper rail 80 and are horizontally spaced from each other. A plurality of lower part grabbers 88 is disposed on the lower rail 82 for engaging a work-piece 26. The lower part grabbers 88 extend upwardly from the lower rail 82 and are horizontally spaced from each other to correspond with the plurality of upper part grabbers 86.

The transfer assembly 22 includes a control system 90 for controlling the arms 56, 58, 62, 64 and the rails 80, 82. The control system 90 is programmed to engage the work-piece 26 and move it into the first station of the die 24 and is programmed for sequentially operating the part grabbers 86, 88 to engage a work-piece 26 and for operating the rail transfer modules 74 to move the rails 80, 82 horizontally parallel to the station-axis Y to move the part grabbers 86, 88 to the first cavity 36 of the die 24 and for operating the longitudinal servo motors 78 to move the arms 56, 58, 62, 64 forwardly parallel to the in/out-axis X and for operating the part grabbers 86, 88 to disengage the work-piece 26 in the first cavity 36 of the die 24 and for operating the longitudinal servo motors 78 to move the arms 56, 58, 62, 64 backwardly parallel to the in/out-axis X and for operating the vertical servo motors 76 to move the top arms 56, 62 upwardly parallel to the vertical-axis Z and the bottom arms 58, 64 downwardly parallel to the vertical-axis Z and for operating the actuator 32 of the press 25 to move the front and back halves 28, 30 of the die 24 together to a closed position to hydroform or hydrotrim the work-piece 26 and for operating the actuator 32 of the press 25 to move the front and back halves 28, of the die 24 apart into an open position.

The control system 90 is also programmed to move the work-piece 26 between stations of the die 24 and is programmed for sequentially operating the longitudinal servo motors 78 to move the arms 56, 58, 62, 64 forwardly parallel to the in/out-axis X and for operating the part grabbers 86, 88 to engage the work-piece 26 and for operating the longitudinal servo motors 78 to move the arms 56, 58, 62, 64 backwardly parallel to the in/out-axis X to remove the work-piece 26 from a first cavity 36 of the die 24 and for operating the rail transfer modules 74 to move the rails 80, 82 horizontally parallel to the station-axis Y for moving the work-piece 26 to a second cavity 38 of the die 24 and for operating the longitudinal servo motors 78 to move the arms 56, 58, 62, 64 forwardly parallel to the in/out-axis X for placing the work-piece 26 in the second cavity 38 of the die 24 and for operating the part grabbers 86, 88 to disengage the work-piece 26 in the second cavity 38 of the die 24 and for operating the longitudinal servo motors 78 to move the arms 56, 58, 62, 64 backwardly parallel to the in/out-axis X and for operating the rail transfer modules 74 to move the rails 80, 82 horizontally parallel to the station-axis Y to move the part grabbers 86, 88 back to the first cavity 36 of the die 24 and for operating the vertical servo motors 76 to move the top arms 56, 62 upwardly parallel to the vertical-axis Z and the bottom arms 58, 64 downwardly parallel to the vertical-axis Z and for operating the front and back halves 28, 30 of the die 24 to move together into a closed position to hydroform or hydrotrim the work-piece 26 and for operating the front and back halves 28, 30 of the die 24 to move apart into an open position.

The control system 90 is also programmed to remove the work-piece 26 from the final station of the die 24 and is programmed for sequentially operating the part grabbers 86, 88 to engage the work-piece 26 and for operating the longitudinal servo motors 78 to move the arms 56, 58, 62, 64 backwardly parallel to the in/out-axis X to remove the work-piece 26 from the final station of the die 24 and for operating the rail transfer modules 74 to move the rails 80, 82 horizontally parallel to the station-axis Y for moving the work-piece 26 away from the die 24 and for operating the part grabbers 86, 88 to disengage the work-piece 26.

The invention also includes a method for forming a work-piece 26 in a die 24 having at least one station and a horizontal in/out-axis X and a horizontal station-axis Y perpendicular to the in/out-axis X and a vertical-axis Z including. The method starts with the step of engaging a work-piece 26 with an upper part grabber 86 connected to an upper rail 80 extending horizontally parallel to the station-axis Y and engaging the work-piece 26 with a lower part grabber 88 connected to a lower rail 82 extending horizontally parallel to the station-axis Y. The method continues with the step of moving the upper and lower rails 80, 82 horizontally parallel to the station-axis Y to move the work-piece 26 to a first station of a die 24. The method continues with the step of moving the upper and lower rails 80, 82 forward parallel to the in/out-axis X to place the work-piece 26 in the first station. The method continues with the step of disengaging the work-piece 26 with the part grabbers 86, 88 in the first station.

The die 24 may include only a single station, or cavity, or it may include multiple stations, or cavities 36, 38. Where the die 24 includes multiple stations, the method includes the step of engaging one end of the work-piece 26 in the first cavity 36 of the die 24 with an upper part gabber 86 and engaging the other end of the work-piece 26 with a lower part grabber 88. The method continues with the step of moving the upper and lower rails 80, 82 backward parallel to the in/out-axis X to remove the work-piece 26 from the first cavity 36 of the die 24. The method further includes the step of moving the upper and lower rails 80, 82 horizontally parallel to the station-axis Y to move the work-piece 26 to a second cavity 38 of the die 24. The method further proceeds with the step of moving the upper and lower rails 80, 82 forward parallel to the in/out-axis X to place the work-piece 26 in the second cavity 38 of the die 24 and disengaging the work-piece 26 with the part grabbers 86, 88 in the second cavity 38. The method continues with the step of moving the upper and lower rails 80, 82 horizontally parallel to the station-axis to position the part grabbers 86, 88 at the first cavity 36.

Whether the die 24 only has a single station or multiple stations, the method proceeds with the step of engaging the work-piece 26 in the last station of the die 24 with the upper part grabber 86 connected to the upper rail 80 and engaging the work-piece 26 with the lower part grabber 88 connected to the lower rail 82. The method continues with the step of moving the upper and lower rails 80, 82 backward parallel to the in/out-axis X to remove the work-piece 26 from the last station of the die 24. The method continues with the step of moving the upper and lower rails 80, 82 horizontally parallel to the station-axis Y to move the work-piece 26 away from the die 24. The method continues with the step of disengaging the work-piece 26 with the part grabbers 86, 88.

In order to move the upper and lower rails 80, 82 out of the way to make room for the die 24 to close, the method is concluded with the step of moving the upper rail 80 vertically upward parallel to the vertical-axis Z and moving the lower rail 82 vertically downward parallel to the vertical-axis Z and closing the die 24 to hydroform or hydrotrim the work-piece 26.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A forming machine (20) including a transfer assembly (22) having a horizontal in/out-axis (X) and a horizontal station-axis (Y) perpendicular to the in/out-axis (X) and a vertical-axis (Z) comprising:

a left post (40) and a right post (42) spaced from and parallel to each other and parallel to the vertical-axis (Z), a left top arm (56) extending transversely from said left post (40) and parallel to the in/out-axis (X) to an outer distal end (60), a right top arm (62) extending transversely from said right post (42) and parallel to the in/out-axis (X) to said outer distal end (60), a left top transfer module (66) interconnecting said left post (40) and said left top arm (56) for moving said left top arm (56) in and out parallel to the in/out-axis (X) and vertically up and down relative to said left post (40) parallel to the vertical-axis (Z), a right top transfer module (70) interconnecting said right post (42) and said right top arm (62) for moving said right top arm (62) in and out parallel to the in/out-axis (X) and vertically up and down relative to said right post (42) parallel to the vertical-axis (Z), an upper rail (80) extending across said distal ends (60) of said left top arm (56) and said right top arm (62) and parallel to the station-axis (Y), a rail transfer module (74) disposed on each of said top arms (56, 62,) and operatively connecting said upper rail (80) to said distal ends (60) of said top arms (56, 62,), and at least one upper part grabber (86) disposed on said upper rail (80) for engaging a work-piece (26).

2. An assembly as set forth in claim 1 further including:

a left bottom arm (58) extending in spaced and parallel relationship with said left top arm (56) and transversely to said left post (40) and parallel to the in/out-axis (X) to said outer distal end (60), a right bottom arm (64) extending in spaced and parallel relationship with said right top arm (62) and transversely to said right post (42) and parallel to the in/out-axis (X) to said outer distal end (60), a left bottom transfer module (68) interconnecting said left post (40) and said left bottom arm (58) for moving said left bottom arm (58) in and out parallel to the in/out-axis (X) and vertically up and down relative to said left post (40) parallel to the vertical-axis (Z), a right bottom transfer module (72) interconnecting said right post (42) and said right bottom arm (64) for moving said right bottom arm (64) in and out parallel to the in/out-axis (X) and vertically up and down relative to said right post (42) parallel to the vertical-axis (Z), and a lower rail (82) extending across said distal ends (60) of said left bottom arm (58) and said right bottom arm (64) and parallel to the station-axis (Y), and said rail transfer module disposed on each of said bottom arms (58, 64) and operatively connecting said lower rail (82) to said distal ends (60) of said bottom arms (58, 64).

3. An assembly as set forth in claim 2 further including at least one lower part grabber (88) disposed on said lower rail (82) for engaging the work-piece (26).

4. An assembly as set forth in claim 3 wherein said at least one upper part grabber (86) is a plurality of upper part grabbers (86) being horizontally spaced from one another.

5. An assembly as set forth in claim 4 wherein said at least one lower part grabber (88) is a plurality of lower part grabbers (88) being horizontally spaced from each other to correspond with said plurality of upper part grabbers (86) for engaging the work-piece (26).

6. An assembly as set forth in claim 2 wherein each of the arms (56, 58, 62, 64) is of the same length.

7. An assembly as set forth in claim 2 wherein said top arms (56, 62) are vertically spaced parallel to the vertical-axis (Z) from said bottom arms (58, 64).

8. An assembly as set forth in claim 2 wherein each of said rails (80, 82) has a rail length (L) between rail ends (84) greater than the distance between said arms (56, 58, 62, 64) parallel to the station-axis (Y).

9. An assembly as set forth in claim 1 further including a die (24) defining at least one forming station.

10. An assembly as set forth in claim 9 wherein said at least one forming station is a plurality of forming stations for successively forming the work-piece (26).

11. An assembly as set forth in claim 10 wherein said die (24) includes a front half (28) and a back half (30) movable relative to one another parallel to the in/out-axis (X) between open and closed positions and presenting a plurality of cavities (36, 38) to define said stations for successively hydroforming the work-piece (26).

12. An assembly as set forth in claim 11 wherein each module includes a longitudinal servo motor (78) for moving the associated arm in and out parallel to the in/out-axis (X) and each module includes a vertical servo motor (76) for moving the associated arm vertically up and down parallel to the vertical-axis (Z).

13. An assembly as set forth in claim 12 and including a control system (90) for sequentially operating said transfer modules (66, 68, 70, 72) and said part grabbers (86, 88) to move said work-piece (26).

14. An assembly as set forth in claim 13 wherein said control system (90) is programmed for sequentially operating said part grabbers (86, 88) to engage the work-piece (26) and for operating said rail transfer modules (74) to move said rails (80, 82) horizontally parallel to the station-axis (Y) to move said part grabbers (86, 88) to a first of said cavities (36, 38) of said die (24) and for operating said longitudinal servo motors (78) to move said arms (56, 58, 62, 64) forwardly parallel to the in/out-axis (X) and for operating said part grabbers (86, 88) to disengage the work-piece (26) in said first cavity (36) of said die (24) and for operating said longitudinal servo motors (78) to move said arms (56, 58, 62, 64) backwardly parallel to the in/out-axis (X) and for operating said vertical servo motors (76) to move said top arms (56, 62) upwardly parallel to the vertical-axis (Z) and said bottom arms (58, 64) downwardly parallel to the vertical-axis (Z) and for operating said actuator (32) of said press (25) to move said front and back halves (28, 30) of said die (24) together to a closed position to form the work-piece (26) and for operating said actuator (32) of said press (25) to move said front and back halves (28, 30) of said die (24) apart into an open position.

15. An assembly as set forth in claim 13 wherein said control system (90) is programmed for sequentially operating said part grabbers (86, 88) to engage the work-piece (26) and for operating said longitudinal servo motors (78) to move said arms (56, 58, 62, 64) backwardly parallel to the in/out-axis (X) to remove the work-piece (26) from one of said cavities (36, 38) of said die (24) and for operating said rail transfer modules (74) to move said rails (80, 82) horizontally parallel to the station-axis (Y) for moving the work-piece (26) away from said die (24) and for operating said part grabbers (86, 88) to disengage the work-piece (26).

16. An assembly as set forth in claim 13 wherein said control system (90) is programmed for sequentially operating said longitudinal servo motors (78) to move said arms (56, 58, 62, 64) forwardly parallel to the in/out-axis (X) and for operating said upper part grabbers (86) to engage the work-piece (26) and for operating said longitudinal servo motors (78) to move said arms (56, 58, 62, 64) backwardly parallel to the in/out-axis (X) to remove the work-piece (26) from a first cavity (36) of said die (24) and for operating said rail transfer modules (74) to move said upper rail (80) horizontally parallel to the station-axis (Y) for moving the work-piece (26) to a second cavity (38) of said die (24) and for operating said longitudinal servo motors (78) to move said arms (56, 58, 62, 64) forwardly parallel to the in/out-axis (X) for placing the work-piece (26) in said second cavity (38) of said die (24) and for operating said upper part grabbers (86) to disengage the work-piece (26) in said second cavity (38) of said die (24) and for operating said longitudinal servo motors (78) to move said arms (56, 58, 62, 64) backwardly parallel to the in/out-axis (X) and for operating said rail transfer modules (74) to move said upper rail (80) horizontally parallel to the station-axis (Y) to move said upper part grabbers (86) back to the first cavity (36) of said die (24) and for operating said vertical servo motors (76) to move said top arms (56, 62) upwardly parallel to the vertical-axis (Z) and for operating said front and back halves (28, 30) of said die (24) to move together into a closed position to form the work-piece (26) and for operating said front and back halves (28, 30) of said die (24) to move apart into an open position.

17. An assembly as set forth in claim 1 wherein said posts (40, 42) have bottoms (44) for engaging a support surface (46) and extend upwardly to tops (48).

18. An assembly as set forth in claim 17 further including a horizontal member (50) extending parallel to the station-axis (Y) between and interconnecting said tops (48) of said posts (40, 42).

19. An assembly as set forth in claim 18 further including a left truss (52) disposed under said horizontal member (50) and interconnecting said left post (40) and said horizontal member (50) and a right truss (54) disposed under said horizontal member (50) and interconnecting said right post (42) and said horizontal member (50).

20. An assembly as set forth in claim 1 wherein each module includes a vertical servo motor (76) for moving the associated arm vertically up and down parallel to the vertical-axis (Z).

21. An assembly as set forth in claim 1 wherein each module includes a longitudinal servo motor (78) for moving the associated arm in and out parallel to the in/out-axis (X).

22. An assembly as set forth in claim 1 wherein said at least one upper part grabber (86) extends downwardly from said upper rail (80).

23. An assembly as set forth in claim 1 wherein said at least one upper part grabber (86) is a plurality of upper part grabbers (86) being horizontally spaced from one another.

24. A forming machine (20) including a transfer assembly (22) having a horizontal in/out-axis (X) and a horizontal station-axis (Y) perpendicular to the in/out-axis (X) and a vertical-axis (Z) comprising:

a die (24) having a die width ($W_{die}$) and a die height ($H_{die}$), said die (24) including a front half (28) and a back half (30) and an actuator (32) for moving said halves (28, 30) relative to one another between open and closed positions, said die (24) including a plurality of cylindrical guides (34) extending through said front and back halves (28, 30) for guiding said die (24) to said open and closed positions, a left post (40) and a right post (42) spaced from and parallel to each other and parallel to the vertical-axis (Z), said posts (40, 42) having bottoms (44) for engaging a support surface (46) and extending vertically upward to tops (48)

a horizontal member (50) extending parallel to the station-axis (Y) between and interconnecting said tops (48) of said posts (40, 42), a left truss (52) disposed under said horizontal member (50) and interconnecting said left post (40) and said horizontal member (50) and a right truss (54) disposed under said horizontal member (50) and interconnecting said right post (42) and said horizontal member (50), said die (24) defining a plurality of forming stations spaced from each other along said station-axis (Y) for successively hydroforming a work-piece (26), said front half (28) and said back half (30) of said die (24) being moveable parallel to the in/out-axis (X) and presenting a plurality of cavities (36, 38) to define said stations for successively hydroforming the work-piece (26), said left and right posts (40, 42) having a post height ($H_{post}$) being greater than said die height ($H_{die}$), a left top arm (56) and a left bottom arm (58) extending in spaced and parallel relationship with each other transversely to said posts (40, 42) and parallel to the in/out-axis (X) to outer distal ends (60), a right top arm (62) and a right bottom arm (64) extending in spaced and parallel relationship with each other transversely to said posts (40, 42) and parallel to the in/out-axis (X) to outer distal ends (60), said top arms (56, 62) being vertically spaced parallel to the vertical-axis (Z) from said bottom arms (58, 64), said left and right arms (56, 58, 62, 64) being horizontally spaced from each other by an interior width ($W_{interior}$) being greater than said die width ($W_{die}$), all of said arms (56, 58, 62, 64) being of the same length, a left top transfer module (66) interconnecting said left post (40) and said left top arm (56) for moving said left top arm (56) in and out parallel to the in/out-axis (X) and vertically up and down relative to said left post (40) parallel to the vertical-axis (Z), a left bottom transfer module (68) interconnecting said left post (40) and said left bottom arm (58) for moving said left bottom arm (58) in and out parallel to the in/out-axis (X) and vertically up and down relative to said left post (40) parallel to the vertical-axis (Z), a right top transfer module (70) interconnecting said right post (42) and said right top arm (62) for moving said right top arm (62) in and out parallel to the in/out-axis (X) and vertically up and down relative to said right post (42) parallel to the vertical-axis (Z), a right bottom transfer module (72) interconnecting said right post (42) and said right bottom arm (64) for moving said right bottom arm (64) in and out parallel to the in/out-axis (X) and vertically up and down relative to said right post (42) parallel to the vertical-axis (Z), each of said transfer modules (66, 68, 70, 72) including a vertical servo motor (76) for moving the associated arm vertically up and down parallel to the vertical-axis (Z), each of said transfer modules (66, 68, 70, 72) including a longitudinal servo motor (78) for moving the associated arm in and out parallel to the in/out-axis (X), an upper rail (80) extending across said distal ends (60) of said left top arm (56) and said right top arm (62) and parallel to the station-axis (Y), a lower rail (82) extending across said distal ends (60) of said left bottom arm (58) and said right bottom arm (64) and parallel to the station-axis (Y), each of said rails (80, 82) having a rail length (L) between rail ends (84) greater than the distance between said arms (56, 58, 62, 64) parallel to the station-axis (Y), a rail transfer module (74) disposed on each of said arms (56, 58, 62, 64) and operatively connecting said rails (80, 82) to said distal ends (60) of said arms (56, 58, 62, 64), a plurality of upper part grabbers (86) disposed on and extending downwardly from said upper rail (80) and being horizontally spaced from each other for engaging a work-piece (26), a plurality of lower part grabbers (88) disposed on and extending upwardly from said lower rail (82) and being horizontally spaced from each other to correspond with said plurality of upper part grabbers (86) for engaging a work-piece (26), and a control system (90) for sequentially operating said longitudinal servo motors (78) to move said arms (56, 58, 62, 64) forwardly parallel to the in/out-axis (X) and for operating said part grabbers (86, 88) to engage the work-piece (26) and for operating said longitudinal servo motors (78) to move said arms (56, 58, 62, 64) backwardly parallel to the in/out-axis (X) to remove the work-piece (26) from a first cavity (36) of said die (24) and for operating said rail transfer modules (74) to move said rails (80, 82) horizontally parallel to the station-axis (Y) for moving the work-piece (26) to a second cavity (38) of said die (24) and for operating said longitudinal servo motors (78) to move said arms (56, 58, 62, 64) forwardly parallel to the in/out-axis (X) for placing the work-piece (26) in said second cavity (38) of said die (24) and for operating said part grabbers (86, 88) to disengage the work-piece (26) in said second cavity (38) of said die (24) and for operating said longitudinal servo motors (78) to move said arms (56, 58, 62, 64) backwardly parallel to the in/out-axis (X) and for operating said rail transfer modules (74) to move said rails (80, 82) horizontally parallel to the station-axis (Y) to move the part grabbers (86, 88) back to the first cavity (36) of said die (24) and for operating said vertical servo motors (76) to move said top ace's (56, 62) upwardly parallel to the vertical-axis (Z) and said bottom arms (58, 64) downwardly parallel to the vertical-axis (Z) and for operating said front and back halves (28, 30) of said die (24) to move together into a closed position to form the work-piece (26) and for operating said front and back halves (28, 30) of said die (24) to move apart into an open position.

* * * * *

UNITED STATES PATENT AND TRADEMARK OFFICE

CERTIFICATE OF CORRECTION

PATENT NO. : 7,971,468 B2
APPLICATION NO. : 12/178079
DATED : July 5, 2011
INVENTOR(S) : Glen Coalson and David A. Sofy It is certified that error appears in the above-identified patent and that said Letters Patent is hereby corrected as shown below:

IN THE SPECIFICATIONS:
column 1, line 44: “for moving the rails” should read -- and for moving the rails
column 4, line 34: “back halves 28” should read -- back halves 28, 30
column 5, line 30: “upper part gabber 86” should read -- upper part grabber 86
column 5, line 44: “station-axis” should read -- station-axis Y IN THE CLAIMS:
column 10, line 54 claim 24: “top ace’s” should read -- top arms Signed and Sealed this
Thirtieth Day of August, 2011

David J. Kappos

David J. Kappos
*Director of the United States Patent and Trademark Office*